US011791562B2

(12) United States Patent
Leib et al.

(10) Patent No.: US 11,791,562 B2
(45) Date of Patent: Oct. 17, 2023

(54) RING FOCUS ANTENNA SYSTEM WITH AN ULTRA-WIDE BANDWIDTH

(71) Applicant: Orbit Communication Systems Ltd., Netanya (IL)

(72) Inventors: Alon Leib, Holon (IL); Hanan Keren, Kfar Sava (IL); Shlomo Levi, Shoham (IL); Itzik Krepner, Netanya (IL)

(73) Assignee: ORBIT COMMUNICATION SYSTEMS LTD., Netanya (IL)

( * ) Notice: Subject to any disclaimer, the term of this patent is extended or adjusted under 35 U.S.C. 154(b) by 0 days.

(21) Appl. No.: 17/712,216

(22) Filed: Apr. 4, 2022

(65) Prior Publication Data

US 2022/0247085 A1 Aug. 4, 2022

Related U.S. Application Data

(60) Provisional application No. 63/145,538, filed on Feb. 4, 2021.

(51) Int. Cl.
*H01Q 15/16* (2006.01)
*H01Q 5/55* (2015.01)
(Continued)

(52) U.S. Cl.
CPC ..... *H01Q 15/16* (2013.01); *H01Q 5/55* (2015.01); *H01Q 13/0275* (2013.01); *H01Q 19/136* (2013.01)

(58) Field of Classification Search
CPC ..... H01Q 19/193
See application file for complete search history.

(56) References Cited

U.S. PATENT DOCUMENTS

2002/0008670 A1* 1/2002 Sharman ..... H01Q 1/42 343/840
2004/0257290 A1* 12/2004 Gothard ..... H01Q 19/19 343/781 R
(Continued)

FOREIGN PATENT DOCUMENTS

CN 101488606 A * 7/2009 ..... H01Q 19/193
DE 4200755 A1 * 7/1993 ..... H01Q 13/0266
(Continued)

*Primary Examiner* — Ab Salam Alkassim, Jr.
*Assistant Examiner* — Anh N Ho
(74) *Attorney, Agent, or Firm* — Mark M. Friedman

(57) ABSTRACT

A ring focus antenna system has an ultra-wide bandwidth for receiving and transmitting electromagnetic (EM) signals. The system includes a main reflector having an axis of rotation and a splash plate feed assembly consisting of a waveguide and a sub-reflector which is substantially aligned with the axis of rotation. The sub-reflector has surfaces that include segments of a displaced ellipse, having a first focal point which coincides with an ISO phase center located inside the waveguide and a second focal point located on a ring focus of the main reflector. A dielectric support for the sub-reflector has a shaped boundary which eliminates refraction at the dielectric-air interface. In one embodiment, the ultra-wide bandwidth includes EM frequencies belonging to Ku-band and Ka-band communication frequencies. The waveguide may be configured as a quad-ridged polarizing waveguide.

15 Claims, 7 Drawing Sheets

(51) Int. Cl.
*H01Q 13/02* (2006.01)
*H01Q 19/13* (2006.01)

(56) References Cited

U.S. PATENT DOCUMENTS

| | | | | |
|---|---|---|---|---|
| 2007/0200781 | A1* | 8/2007 | Ahn | H01Q 19/193 343/781 CA |
| 2015/0084821 | A1* | 3/2015 | Rao | H01Q 19/193 343/781 CA |
| 2015/0091769 | A1* | 4/2015 | Zelenski | H01Q 13/0208 343/781 CA |
| 2021/0376480 | A1* | 12/2021 | Brandau | H01Q 13/06 |

FOREIGN PATENT DOCUMENTS

| | | | | |
|---|---|---|---|---|
| EP | 3327408 | A1 * | 5/2018 | G01F 23/284 |
| FR | 2946466 | A1 * | 12/2010 | H01Q 19/193 |
| WO | WO-2015100540 | A1 * | 7/2015 | H01Q 19/193 |

* cited by examiner

RING FOCUS ANTENNA SYSTEM WITH AN ULTRA-WIDE BANDWIDTH

CROSS-REFERENCE TO RELATED APPLICATIONS

This application is related to and claims priority from commonly owned U.S. Provisional Patent Application No. 63/145,538, entitled "Ring Focus Parabolic Antenna with Improved Splash Plate Feed and Ultra-Wide Band Quad-Ridge Polarizer", filed on Apr. 4, 2021, the disclosure of which is incorporated by reference in its entirety herein.

TECHNICAL FIELD

The present invention relates to reflector antennas and polarizer waveguides, and specifically to a ring focus antenna system having an ultra-wide bandwidth.

BACKGROUND OF THE INVENTION

In a satellite communication system, antennas are used to transmit and receive electromagnetic (EM) signals between a terminal station, which may be earthbound, ship borne, or airborne, and an orbiting satellite.

For very small aperture terminal (VSAT) applications, the radiation patterns of an RFA system must satisfy tight constraints on various figures of merit, such as aperture efficiency, main beam-width, side-lobe (SL) level, cross polarization discrimination (XPD), gain-over-noise temperature (G/T), effective isotropic radiated power (EIRP), and voltage standing wave ratio (VSWR).

A technical paper by L. Zhao et al., entitled "A Ring-Focus Antenna with Splash Plate in Ka-Band", and published on 18 Mar. 2018 in Hindawi International Journal of Antennas and Propagation, vol. 2018, article ID 9790143, presents a design for a Ka-band antenna for use in a VSAT earth station of a satellite communication system. The design, which uses a parabolic RFA with a splash plate feed, is claimed to achieve low sidelobe levels and an antenna aperture efficiency of greater than 65%, for Ka-band communication frequencies.

U.S. Pat. No. 6,211,834 to T. E. Durham et al., dated 3 Apr. 2001, and entitled "Multiband Ring Focus Antenna Employing Shaped-Geometry Main Reflector And Diverse-Geometry Shaped Subreflector-Feeds", teaches a multiband, shaped ring focus antenna architecture employing only a single or common main reflector, that is shaped such that it can be shared by each of a pair of interchangeable, diversely shaped close proximity-coupled, subreflector-feed pairs designed for operation at respectively different spectral bands. The operational band of the antenna is changed by swapping out the sub-reflector-feed pairs.

Waveguide polarizing feeds are used in satellite antenna systems to convert a linearly polarized input signal into a circularly polarized output signal. For example, U.S. Pat. No. 6,097,264 to J. M. Vezmar, dated 1 Aug. 2000, and entitled "Broad Band Quad Ridged Polarizer", discloses a broadband quad-ridged waveguide polarizer (QRWP) having four axial ridges, one on each wall of the waveguide. The axial ridges are configured to provide a net phase difference equal to 90 degrees between orthogonal signal components of a linearly polarized input signal, at a predetermined EM frequency.

SUMMARY OF THE INVENTION

The present invention discloses an RFA system having an ultra-wide bandwidth (UWB). For example, the UWB may cover both Ku-band and Ka-band satellite communication frequencies. The system of the invention provides a first side lobe level off peak gain of less than −20 dB and an aperture efficiency of greater than 70% at EM frequencies within the UWB.

According to one aspect of the presently disclosed subject matter, there is provided a ring focus antenna system having an ultra-wide bandwidth for receiving and transmitting electromagnetic (EM) signals. The system includes a main reflector having an axis of rotation and a splash plate feed assembly. The splash plate feed assembly includes an EM waveguide and a sub-reflector which is substantially aligned with the axis of rotation. The sub-reflector includes surfaces that include segments of an ellipse having a first focal point which coincides with an ISO phase center located inside the waveguide and a second focal point located on a ring focus of the main reflector. The sub-reflector is mated to a dielectric support having a shaped boundary which includes a portion of a circle whose center is at the second focal point.

According to some aspects, the EM waveguide is a quad-ridged polarizing (QRP) waveguide having an ultra-wide bandwidth and a central axis.

According to some aspects, the shaped boundary is configured so that EM rays cross perpendicular to the shaped boundary.

According to some aspects, the ultra-wide bandwidth includes EM frequencies belonging to Ku-band and Ka-band communication frequencies.

According to some aspects, the main reflector has a parabolic surface.

According to some aspects, the splash plate feed assembly includes a splash plate feed cone.

According to some aspects, the feed cone has rotational grooves.

According to some aspects, the QRP waveguide includes a pair of conducting horizontal ridges, a pair of conducting vertical ridges, and a dielectric central portion.

According to some aspects, the ridges include a plurality of steps whose dimensions vary with position along the central axis.

According to some aspects, the ridges include a metallic material selected from a group consisting of aluminium, magnesium, zinc, titanium, chromium, gold, and steel.

According to some aspects, the horizontal ridges are arranged at an oblique angle to the vertical ridges.

According to some aspects, the dielectric central portion is configured to have two slabs arranged in a cross-hair shape.

According to some aspects, the system has a far-field radiation pattern whose first side lobe level off peak gain is less than −20 dB for EM frequencies within the UWB.

According to some aspects, the system has an aperture efficiency which is greater than 70% for EM frequencies within the UWB.

According to some aspects, the system is operationally connected to a receiver and a transmitter in a communication system.

BRIEF DESCRIPTION OF THE DRAWINGS

Some embodiments of the present invention are herein described, by way of example only, with reference to the accompanying drawings. With specific reference to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

DETAILED DESCRIPTION OF THE INVENTION

Figure 1:
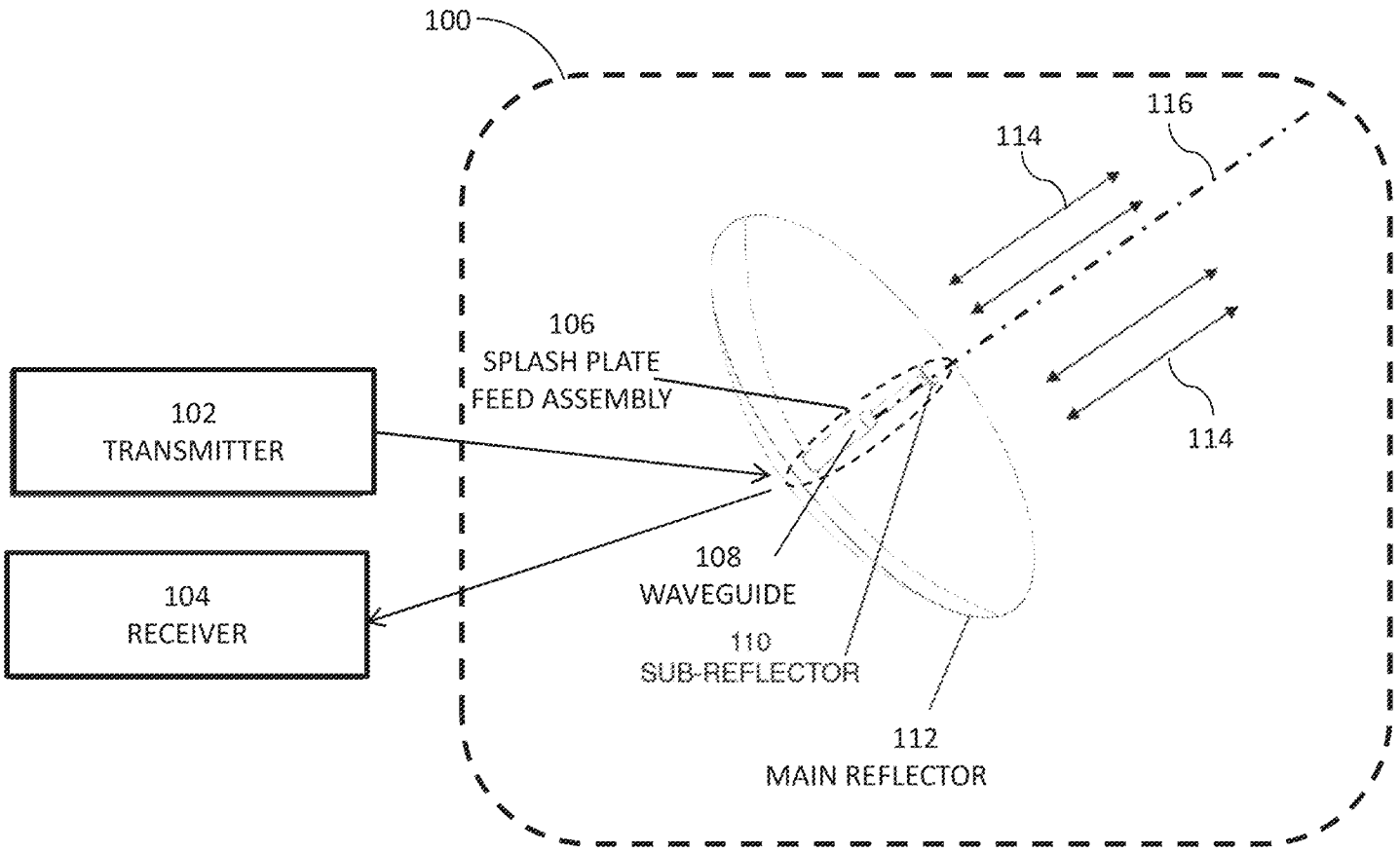
FIG. 1: A diagram of an exemplary antenna system according to an embodiment of the invention.

FIG. 1 shows an antenna system 100 for transmitting and receiving Electromagnetic (EM) signals. Exemplary EM signals include satellite uplink and downlink signals having frequencies in Ka-band and in Ku-band. For simplicity in the current description, generally transmission is described. Based on this transmission description, one skilled in the art will understand the corresponding design, implementation, and operation of reception. Table 1 shows exemplary EM frequencies that are commonly used for Ku-band and Ka-band satellite communication.

TABLE 1

| Communication Frequency Bands | | |
|---|---|---|
| Frequency Band | Downlink (GHZ) | Uplink (GHz) |
| Ku | 10.7-12.2 | 14.0-14.5 |
| Ka | 17.7-21.2 | 27.5-31.0 |

As shown in FIG. 1, an exemplary embodiment of an RFA system 100 includes a splash plate feed assembly 106, shown by a dashed ellipse, and a main reflector 112. The feed assembly 106 includes a waveguide 108 and a sub-reflector 110. In one embodiment, the main reflector 112 has a parabolic surface which is rotationally symmetric about a main reflector axis 116, and the sub-reflector 110 has the shape of an elliptical arc rotated about the same axis 116. Rays 114 are substantially parallel to axis 116, and represent the ray paths of outgoing and incoming EM radiation. In a typical satellite communication system, the RFA system 100 is operationally connected to a transmitter 102 and a receiver 104.

Figure 2:
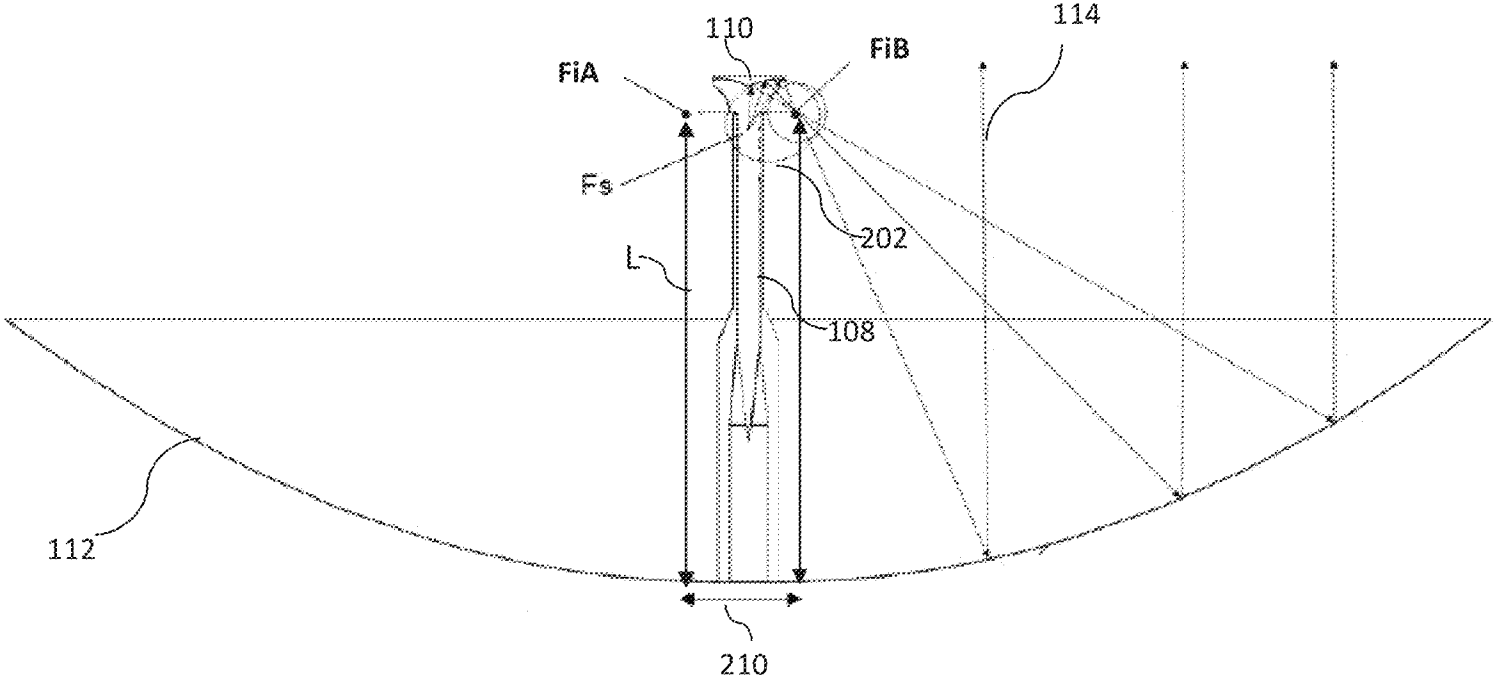
FIG. 2: A cross-sectional drawing of focal points of the antenna system of FIG. 1.

FIG. 2 shows a cross-sectional drawing of focal points of the antenna system of FIG. 1. The main reflector 112 is configured so that its focal points are on a ring focus surrounding the axis 116. Points FiA and FiB represent two points on opposite sides of the ring focus. The diameter 210 of the ring focus is equal to the distance between FiA and FiB. The focal length of the main reflector 112 is denoted by L. Displaced ellipse 202 is offset from axis 116 by a perpendicular distance equal to one-half of the diameter 210.

Figure 3:
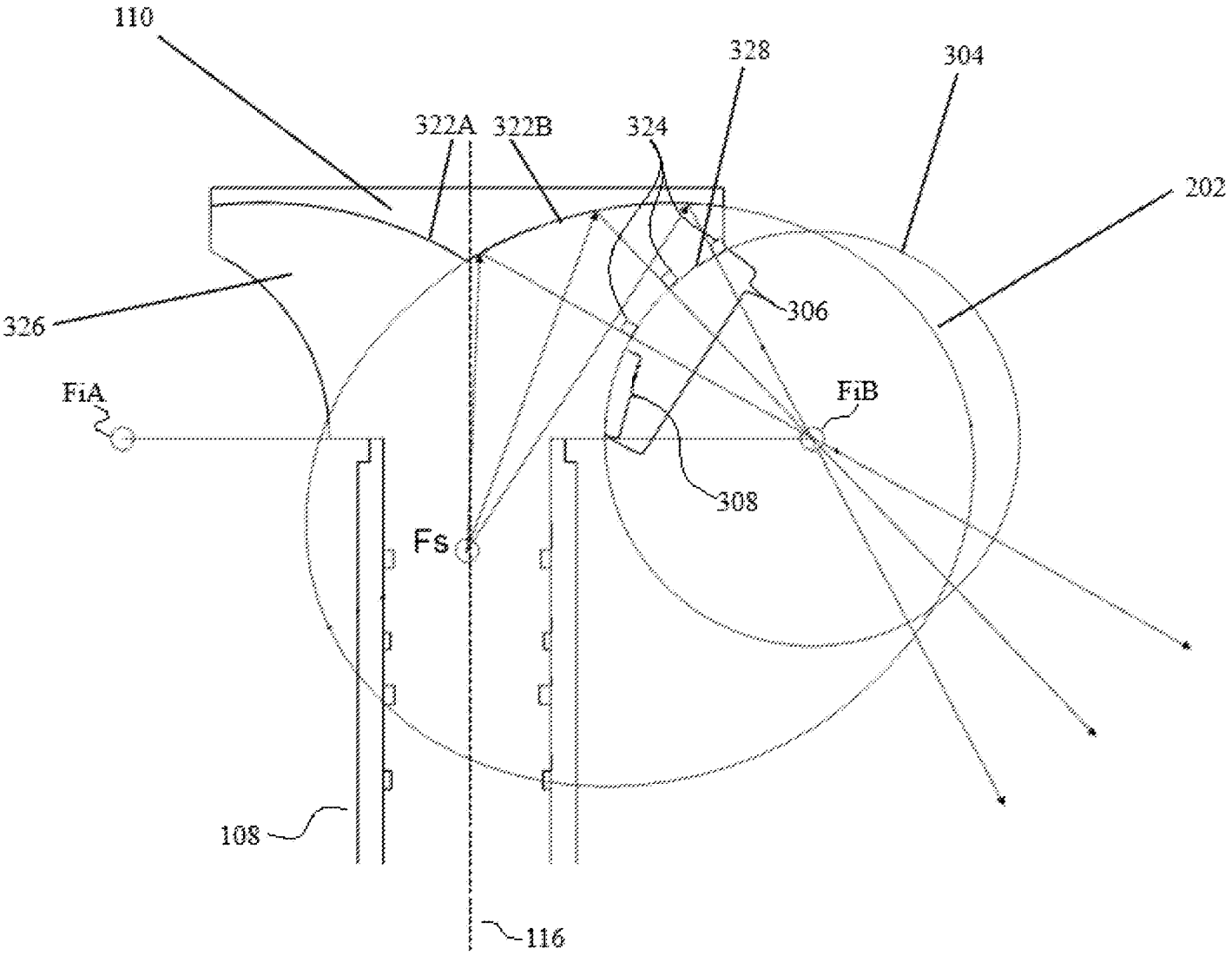
FIG. 3: A drawing showing configuration details of a splash plate feed assembly.

FIG. 3 shows further configuration details of the splash plate feed assembly 106. The surface of sub-reflector 110 contains the elliptical segments 322A and 322B. Points Fs and FiB are the two focal points of the displaced ellipse 202. Point Fs is also an ISO phase center which is located inside the waveguide 108. (A displaced ellipse, which is similar to ellipse 202 and which contains the segment 322A and focal points at Fs and FiA, is not shown in the figure.) In transmission, EM radiation from waveguide 108 is reflected by elliptical segment 322B and converges at focal point FiB. The EM waves 114 are reflected by the main reflector 112 and emitted substantially parallel to the axis of rotation 116.

The sub-reflector 110 is formed by a metallic surface mated to the surface of a dielectric support 326. Shaped boundary 306 indicates the bounding surface of dielectric support 326, and includes a portion of a geometric circle 304 whose center is coincident with the focal point FiB, which is also a focal point of displaced ellipse 202.

Dielectric support 326 has a circular cut 328. EM rays reflected by the elliptical segment 322B pass through the dielectric support 326 and cross the shaped boundary 306 which separates the dielectric material from air in a perpendicular direction. Perpendicularity is indicated in FIG. 3 by the small squares 324 on the shaped boundary 306. According to Snell's law, the angular refraction at the dielectric-to-air interface is equal to zero, for all values of the frequency-dependent index of refraction of the dielectric support. This enables every portion of the EM wave originating from the ISO phase center Fs to be reflected by the elliptical sub-reflector 110, to pass through the dielectric support 326 at normal incidence to the dielectric-air interface, and to generate a focal point FiB located on the ring focus of the main reflector 112.

Optionally, shaped boundary 306 may be implemented to include an occluded portion 308 which is coated by a lossy paint covering applied to an exterior surface of dielectric support 326. The covering reduces backscatter by attenuating distal EM rays which are directed towards an outer edge of the main reflector 112.

In one embodiment, the dielectric support 326 preferably consists of a material having a very low dissipation and a dielectric constant that is preferably in a range of 2.4-2.6 within the Ku-band and Ka-band communication frequencies. The ideal material has negligible outgassing and water absorption and is chemically resistant and light weight. One such material is a cross-linked polystyrene microwave plastic known as Rexolite™, which is available from C-Lec Plastics Inc. and has a dielectric constant equal to 2.53 over a broad range of frequencies.

Figure 4:
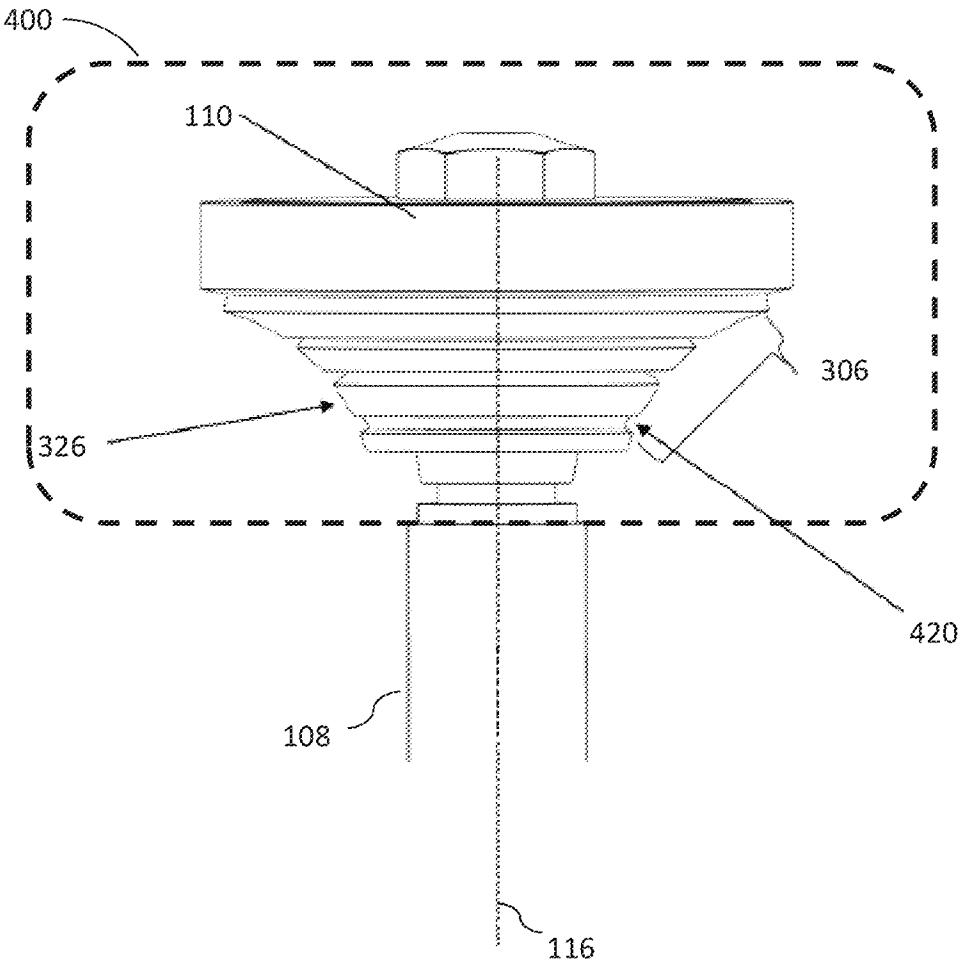
FIG. 4: A drawing showing configuration details of a splash plate feed cone.

FIG. 4 is a drawing showing configuration details of a splash plate feed cone 400. The sub-reflector 110 and dielectric support 326 are viewed from the side, so that the elliptical segments 322A and 322B are hidden from view. Shaped boundary 306 is patterned with grooves 420, which are cut into the dielectric material of support 326. The grooves, which may also be referred to as corrugations, are typically rotationally symmetric about the rotation axis 116. The effect of the grooves is to suppress higher order EM modes of the transmitted (or received) signal inside the dielectric material of support 326. The grooves introduce an asymmetrical reduction in the diameter of the far-field beam and yield a radiation pattern that is close to the ultimate physical limit of diffraction optics.

In another embodiment of the feed cone 400, the shaped boundary 306 may have a shaped surface with variable surface radius, as opposed to a smooth circular surface.

Figure 5:
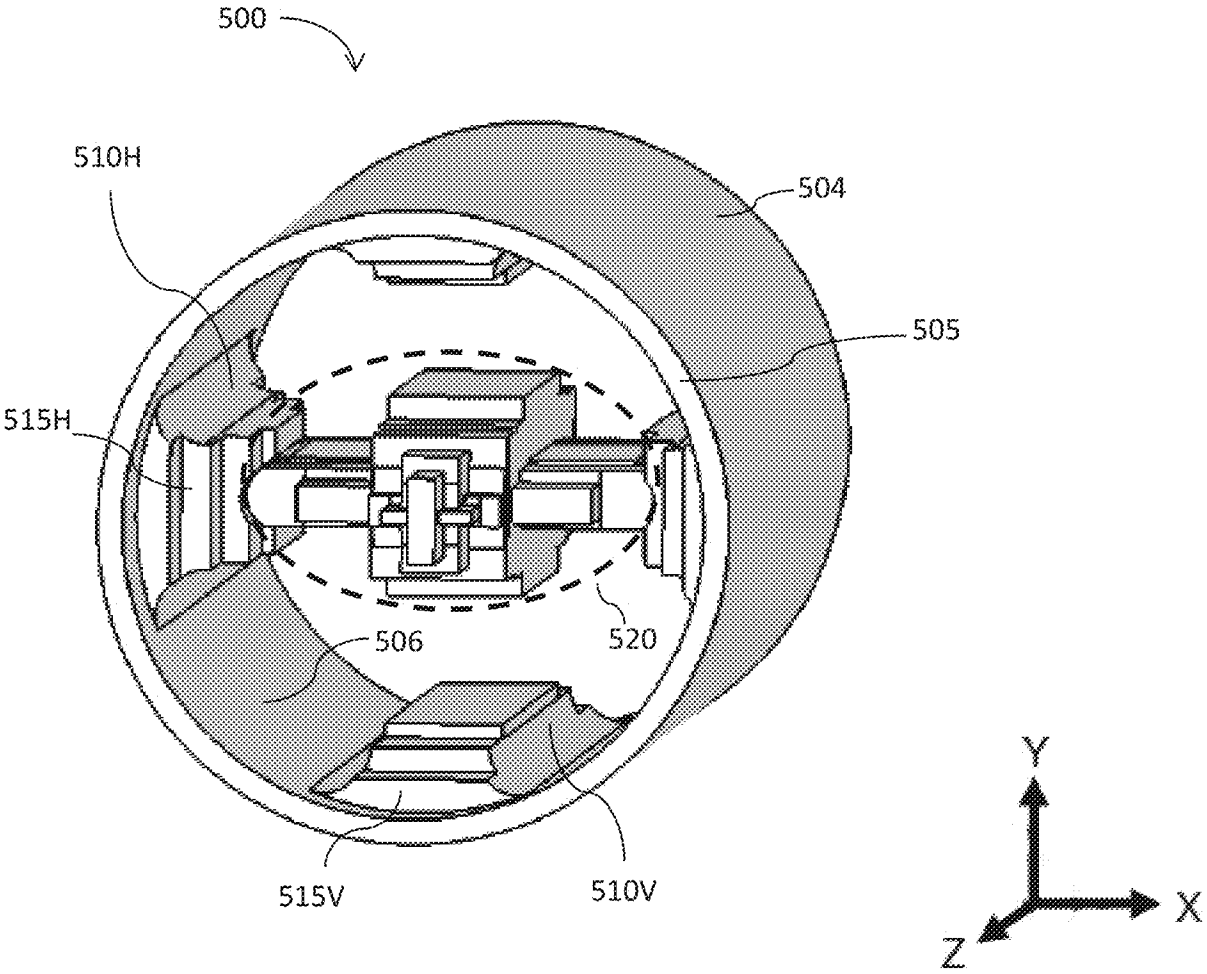
FIG. 5: A perspective drawing of an exemplary polarizing waveguide according to an embodiment of the invention.
Figure 6:
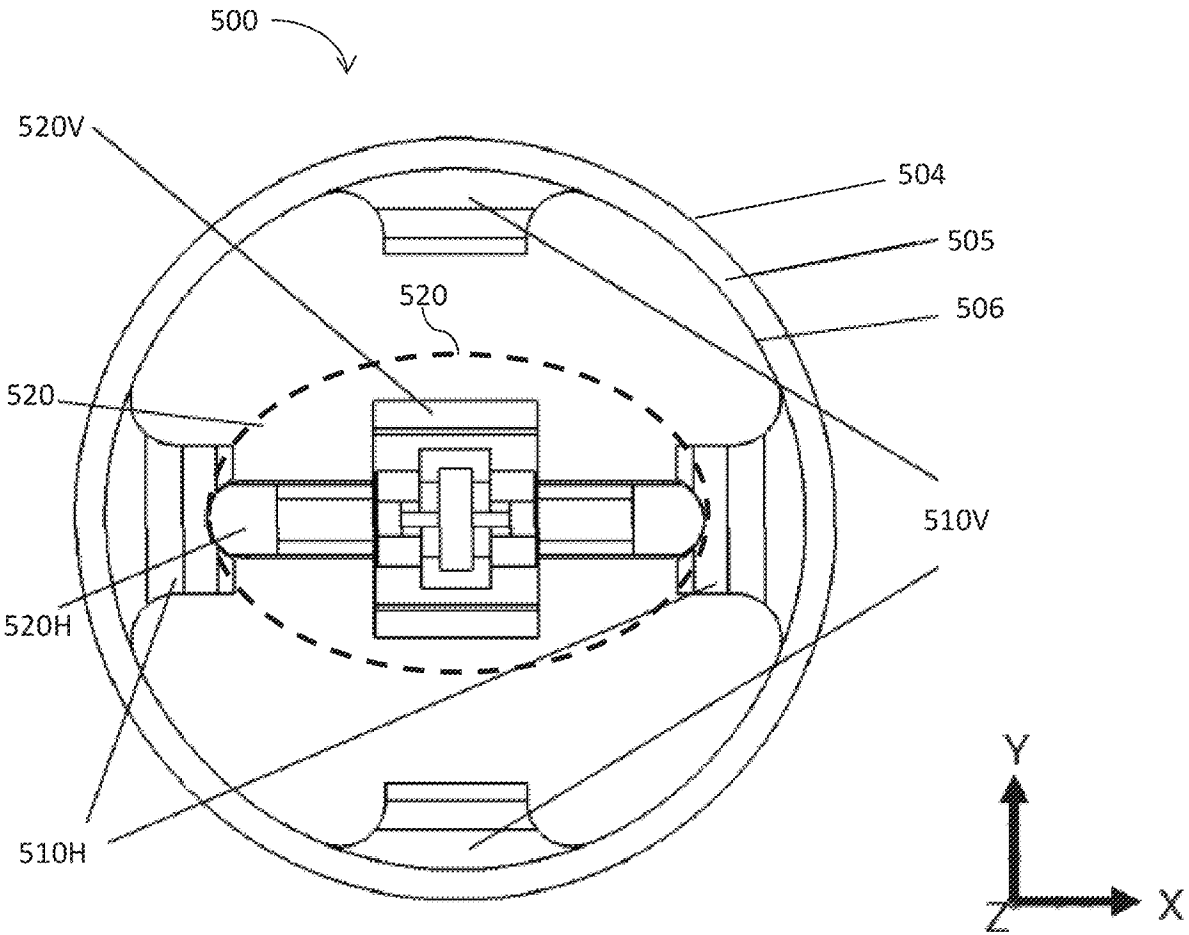
FIG. 6: A cross-sectional drawing of the polarizing waveguide of FIG. 5.

FIG. 5 is a perspective drawing, and FIG. 6 is a cross-sectional drawing, of an exemplary polarizing waveguide 500 according to an embodiment of the invention. Waveguide 500 belongs to a class of waveguides known as Quad-Ridged Polarizing (QRP) Waveguides. Axes X and Y are orthogonal to the Z axis, which is parallel to a central axis of the waveguide and to the rotational axis 116. The waveguide body is typically hollow with a substantially symmetrical cross section.

Polarizing waveguide 500 converts an incoming transverse electric (TE) linearly polarized mode, such as TE11, to a circularly polarized mode, which is essentially two orthogonal linear modes that are shifted in phase by 90 degrees. The components of the waveguide are designed to be specially tapered in order to maintain the 90 degree phase shift between the orthogonal modes over an ultra-wide band of incoming (or outgoing) frequencies, as described below and illustrated in FIGS. 5, 6, 7A, and 7B.

The wall 505 of the waveguide 500 is conducting and is bounded by an exterior conducting surface 504 and an interior conducting surface 506. The material of the wall is preferably an EM reflective metal, such as aluminium, magnesium, zinc, titanium, chromium, gold, or steel.

The interior surface 506 is in electrical contact with a pair of horizontal metallic ridges 510H and a pair of vertical metallic ridges 510V. As used in this description, the terms horizontal and vertical are arbitrary, and relate to the X and Y axes, respectively, as shown in FIG. 5. The ridges may be made of the same material as the wall 505. The ridges may be constructed during machining of the waveguide, or manufactured separately and then attached to the interior surface 506. In either case, the base of each ridge is curved so as to mate with the curvature of the interior surface 506.

Although the ridge pairs 510H and 510V are shown in FIG. 6 as being orthogonal to each other, the orientation may be non-orthogonal, or oblique, in general. Thus, the orthogonal orientation is for the sake of clarity of presentation, and is not intended to be a limiting feature of the invention.

Each pair of ridges, 510H and 510V, has a plurality of steps on the top surface, denoted by 515H and 515V. The height of each step is defined as the distance from the top of the step to the base of the ridge to which it belongs. Typically, the top of each step is parallel to the interior surface 506 of the waveguide, and the step heights vary with distance along the Z-axis. With increasing distance in Z, the steps first increase in height from a pre-determined minimum step height up to a pre-determined maximum step height, and then decrease in height. The configuration of steps in ridges 510H is generally different from that in ridges 510V. For example, the maximum step height of ridges 510H may be greater than that of ridges 510V.

The configuration of steps is symmetrical along the Z-axis so that the polarization conversion takes place in both reception and transmission. In transmission, an input transverse electric (TE) linearly polarized wave entering the waveguide at an oblique angle to the ridges is converted into a circularly polarized output wave; and on reception, an input circularly polarized wave is split into two orthogonal linearly polarized waves.

Figure 7A:
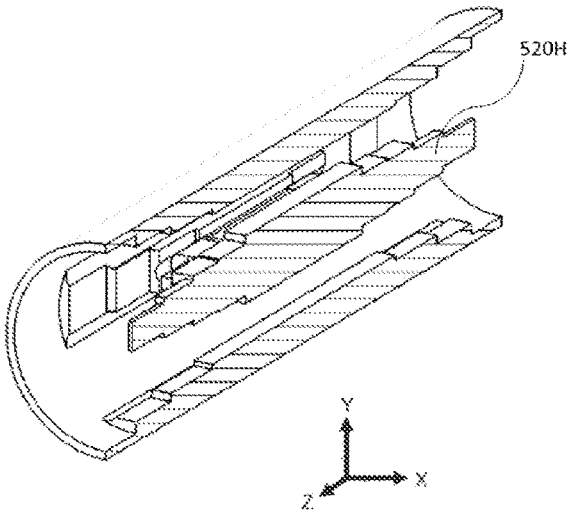
FIGS. 7A-7B: Exploded views of the slabs of the polarizing waveguide of FIG. 5.
Figure 7B:
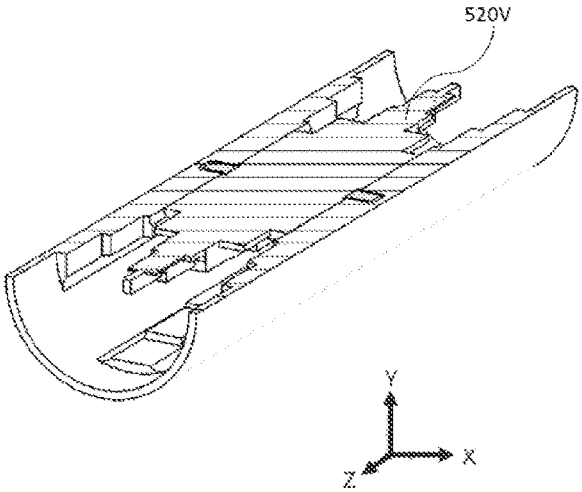

A central portion 520, indicated by a dashed ellipse in FIG. 5 and FIG. 6, runs through the center of the waveguide 500 between the ridges 510H and 510V and has a dual-slab configuration. The slabs are denoted by 520V and 520 H in FIG. 6. The vertical slab 520V is aligned with the vertical ridges 510V, and the horizontal slab 520H is aligned with the horizontal ridges 510H. The slabs are made of a dielectric material, such as the previously mentioned Rexolite™. FIGS. 7A and 7B show exploded views of the slabs.

The central portion 520 appears in FIG. 6 as having a "cross-hair" shape. The two arms of the cross-hair generally differ in width, height, and in the configuration of the steps along Z. For example, the horizontal slab 520H may have higher steps than slab 520V, in order to facilitate attachment of the slab 520H to the ridge pair 510H. The change in the heights of steps 515H and 515V with distance along the Z-axis implies that the separation between the slabs, 520H and 520V, and the corresponding ridges, 510H and 510V, changes with distance along the Z-axis.

The wavelengths of EM waves propagating inside the waveguide 500 are the same for all polarization directions and for all frequencies within the ultra-wide frequency bandwidth. Since wavelength is equal to the ratio of group velocity and frequency, it follows that the group velocity of the EM waves inside the waveguide is proportional to frequency within the ultra-wide frequency bandwidth.

The specific geometry of the ridges and slabs of waveguide 500 is illustrative of a design which may be optimized for satellite communication at EM frequencies in both Ku-band and Ka-band. However, the principles of the invention may readily be applied by those skilled in the art to a variety of other combinations of EM frequency bands.

In general, the descriptions of the various embodiments of the present disclosure have been presented for purposes of illustration, but are not intended to be exhaustive or limited to the embodiments disclosed. Many other modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

The invention claimed is:

1. A ring focus antenna system having an ultra-wide bandwidth for receiving and transmitting electromagnetic (EM) signals, the system comprising a main reflector having an axis of rotation; and a splash plate feed assembly;

wherein, the splash plate feed assembly comprises an EM waveguide and a sub-reflector which is substantially aligned with the axis of rotation;

the sub-reflector comprises surfaces that include segments of a displaced ellipse having a first focal point which coincides with an ISO phase center located inside the waveguide and a second focal point located on a ring focus of the main reflector; and the sub-reflector is mated to a dielectric support having a shaped boundary which includes a portion of a circle whose center is at the second focal point.

2. The system of claim 1 wherein the EM waveguide is a quad-ridged polarizing (QRP) waveguide having the ultra-wide bandwidth and a central axis.

3. The system of claim 1 wherein the shaped boundary is configured so that EM rays cross perpendicular to the shaped boundary.

4. The system of claim 1 wherein the ultra-wide bandwidth includes EM frequencies belonging to Ku-band and Ka-band communication frequencies.

5. The system of claim 1 wherein the main reflector has a parabolic surface.

6. The system of claim 1 wherein the splash plate feed assembly comprises a splash plate feed cone.

7. The system of claim 6 wherein the feed cone has rotational grooves.

8. The system of claim 2 wherein the QRP waveguide comprises a pair of conducting horizontal ridges, a pair of conducting vertical ridges, and a dielectric central portion.

9. The system of claim 8 wherein the ridges comprise a plurality of steps whose dimensions vary with position along the central axis.

10. The system of claim 8 wherein the ridges comprise a metallic material selected from a group consisting of aluminium, magnesium, zinc, titanium, chromium, gold, and steel.

11. The system of claim 8 wherein the horizontal ridges are arranged at an oblique angle to the vertical ridges.

12. The system of claim 8 wherein the dielectric central portion is configured to have two slabs arranged in a cross-hair shape.

13. The system of claim 1 wherein a far-field radiation pattern has a first sidelobe level off peak gain of less than −20 dB for EM frequencies within the ultra-wide bandwidth.

14. The system of claim 1 wherein an aperture efficiency is greater than 70% for EM frequencies within the ultra-wide bandwidth.

15. The system of claim 1 operationally connected to a receiver and a transmitter in a communication system.

* * * * *